United States Patent [19]

Winter, III

[11] 4,333,823

[45] Jun. 8, 1982

[54] CORROSION INHIBITION IN AROMATIC LIQUID EXTRACTION

[75] Inventor: George R. Winter, III, Mt. Prospect, Ill.

[73] Assignee: UOP Inc., Des Plaines, Ill.

[21] Appl. No.: 185,102

[22] Filed: Sep. 8, 1980

[51] Int. Cl.[3] ..... C10G 21/22

[52] U.S. Cl. ..... 208/325; 585/857

[58] Field of Search ..... 208/325; 585/857

[56] References Cited

U.S. PATENT DOCUMENTS

| | | | |
|---|---|---|---|
| 3,385,783 | 5/1968 | Okuma | 208/321 |
| 3,385,784 | 5/1968 | Okuma et al. | 208/321 |
| 3,466,345 | 9/1969 | De Graff et al. | 260/674 |
| 3,492,222 | 1/1970 | Van Tassell | 208/321 |
| 3,642,614 | 2/1972 | Van Tassell | 208/321 |

*Primary Examiner*—Delbert E. Gantz
*Assistant Examiner*—William Leader
*Attorney, Agent, or Firm*—James R. Hoatson, Jr.; Louis A. Morris; William H. Page, II

[57] ABSTRACT

This invention provides a unique means of effective corrosion inhibition and corrosion inhibitor utilization in a process for the extraction of aromatics from a hydrocarbon mixture using sulfolane. The corrosion inhibitor used is an organic amine. The invention involves introduction of the inhibitor into the overhead receiver of the benzene fractionation column and the recycle of water collected in that receiver to the stripper column overhead receiver. The inhibitor is thus effectively distributed throughout the process.

6 Claims, 1 Drawing Figure

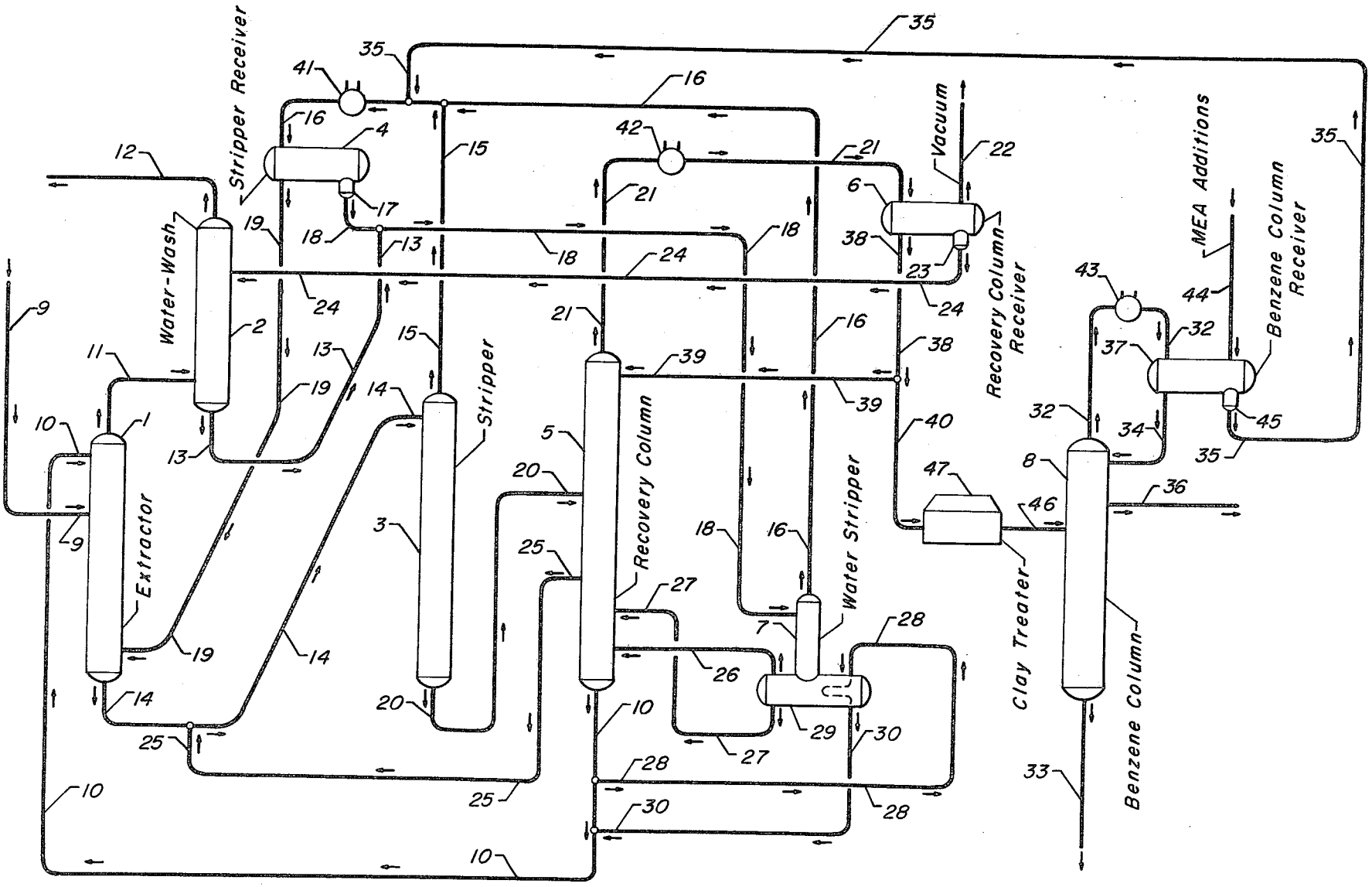
Benzene Column Receiver
MEA Additions
Benzene Column
Clay Treater
Recovery Column Receiver
Vacuum
Water Stripper
Recovery Column
Stripper
Stripper Receiver
Water-Wash
Extractor

CORROSION INHIBITION IN AROMATIC LIQUID EXTRACTION

BACKGROUND OF THE INVENTION

1. Field of the Invention

The field of art to which this invention pertains is aromatic liquid extraction. More specifically, the invention relates to the use of an organic amine corrosion inhibitor in an aromatic sulfolane type organic compound liquid extraction process.

2. Prior Art

It is known in the art that a conventional process for the recovery of high purity aromatic hydrocarbons of, say, nitration grade from various feedstocks including catalytic reformates is liquid-liquid extraction utilizing a solvent such as diethylene glycol or sulfolane, each of which has high selectivity for the desired aromatic hydrocarbon components contained in the feedstock. Typically, in the practice of such prior art process a hydrocarbon feed mixture is contacted in an extraction zone with an aqueous solvent composition which selectively dissolves the aromatic component of the hydrocarbon feedstock thereby forming a raffinate phase comprising one or more non-aromatic hydrocarbons and an extract phase containing dissolved aromatic components. The extract phase is then separately distilled yielding an overhead distillate containing only a portion of the extracted aromatic component, a sidecut fraction comprising aromatic hydrocarbons and a bottoms fraction comprising lean solvent suitable for reuse in the extraction zone. Frequently to prevent losses of the solvent, the raffinate phase is washed with water in a washing zone in order to remove solvent from the raffinate phase.

Also, not infrequently, the extract phase is subjected to stripping or extractive distillation in order to remove a contaminating quantity of non-aromatic hydrocarbons from the extract phase. This stripping or extractive distillation operation is normally performed in order to make possible the recovery of nitration grade aromatic hydrocarbons such as benzene and toluene. Therefore, a typical prior art process for the recovery of aromatic hydrocarbons encompasses a solvent extraction step, a stripping or extractive distillation step, and a final distillation or recovery step for recovery of high purity aromatic hydrocarbons from the solvent phase. Another prior art step, more fully discussed hereinbelow, is a benzene distillation step which has as its function the recovery of benzene from the other aromatics.

The solvents which are applicable to the practice of the present invention and to the aromatics extraction process, generally, are known to be thermally unstable. The instability is not pronounced, however, and only becomes evident upon prolonged recycling of the solvent whereupon the accumulation of the decomposition products becomes evident. Generally, the rate of decomposition increases with increasing operating temperatures. Thus, it has been found that the rate of decomposition, for example, of sulfolane in an inert atmosphere is 0.002% per hour at 200° C., 0.01% per hour at 220° C., and 0.02% per hour at 230° C. Similar thermal effects are observed with other satisfactory solvents and it is therefore desirable to keep temperature levels as low as possible. Accordingly, it is the practice, for example when using the sulfolane solvent system, to set a maximum process temperature of about 370° F. while in the diethylene glycol solvent system it is the practice to set a maximum process temperature of about 380° F. Consequently, the prior art defines such processing temperatures as being the point of thermal instability; although, it is known that there is some decomposition occurring below those temperature levels, and in some instances, temperatures above these temperature limits may be utilized for short periods of time. Similar points of thermal instability may be readily ascertained for other solvent systems.

It is known that the solvent decomposition results in the production of acidic organic deterioration products as well as polymerization products of a resinous character. It is further believed that the decomposition is accelerated by the presence of oxygen. The exact nature of the final decomposition products is not fully known, but where sulfolane is the solvent, the decomposition initially produces sulfur dioxide, sulfur trioxide, and olefins.

The presence of organic acids within the aqueous solvent and of sulfurous gases within an aqueous sulfolane solvent tends to cause accelerated corrosion of the steel materials used in the construction of the process unit, particularly when water is present which is usually the case. Therefore, it is the usual prior art practice to add organic amine compounds to the solvent composition as corrosion inhibitors. U.S. Pat. Nos. 3,385,783; 3,385,784; 3,466,345; and 3,642,614 all mention such use of organic amine compounds. Suitable organic amines for use in the solvent composition may be selected from the aliphatic, aromatic, naphthenic, and hetrocyclic amines, generally, as well as the alkanolamines containing one or more amine groups and/or hydroxy groups per molecule. The amine may also be a primary, secondary, or tertiary amine, but the preferred amine utilized as a corrosion inhibitor in the sulfolane solvent system is an alkanolamine, and more particularly, monoethanolamine. Because of the basic characteristics of these amine inhbitors, these materials react with the acidic solvent decomposition products to produce amine salts and amides at the temperature conditions utilized in the aromatic extraction process and thereby maintain solvent pH at a level far less conducive to corrosion.

The location in the aromatic extraction process at which the organic amine compounds are known in the art to be introduced is in the stripper receiver vessel. Addition at that location will provide inhibitor protection, of course, in the stripper overhead receiver, but also in the extractor, since hydrocarbons from the stripper are normally refluxed to the extractor. There is a problem, however, with the inhibitor addition as described above, because, due to loss in process product streams and consumption, very little inhibitor will be left in the process far downstream or upstream of the inhibitor addition point, particularly at the benzene column or benzene column overhead receiver, and, therefore, corrosion will occur at those downstream locations when solvent and solvent decomposition products are present. I have discovered a means of solving that problem.

SUMMARY OF THE INVENTION

Accordingly, the objective of my invention is to modify and improve the known method of addition of organic amine corrosion inhibitor to the sulfolane type organic compound aromatic liquid extraction process and to modify the process flow itself so as to achieve corrosion inhibition throughout the process equipment.

In brief summary, my invention is a process for the recovery of aromatic hydrocarbons from a mixture thereof with non-aromatic hydrocarbons, which process comprises the steps of: (a) introducing the mixture into an extraction zone, and therein contacting the mixture with a solvent comprising a sulfolane type organic compound characteristically selective for absorbing aromatic hydrocarbons; (b) removing a non-aromatic raffinate stream from the zone, through an upper locus thereof; (c) removing an aromatic, solvent-rich extract stream from the zone, through a lower locus thereof, and introducing the extract stream into a stripper column; (d) removing a non-aromatic concentrate from said stripper column, through an upper locus thereof, and removing a solvent-rich aromatic concentrate from said stripper column, through a lower locus thereof; (e) combining the non-aromatic concentrate with a hereafter described high water content stream containing organic amine and introducing the combination into a stripper condenser, removing non-aromatic concentrate containing organic amine from the stripper receiver vessel and passing the non-aromatic concentrate containing organic amine as reflux into the extraction zone; (f) introducing the aromatic concentrate into a recovery column, recovering a substantially solvent-free aromatic concentrate through an upper locus thereof, and removing a substantially hydrocarbon free solvent-rich stream from a lower locus thereof; (g) introducing the solvent-free aromatic concentrate into a benzene column, recovering a substantially pure benzene concentrate through an upper locus thereof, and removing a substantially benzene-free aromatic product stream from a lower locus thereof; (h) introducing the benzene concentrate into a benzene column receiver vessel; (i) introducing an organic amine into said benzene column receiver vessel; (j) removing benzene reflux containing organic amine from the benzene column receiver vessel and introducing such reflux to the benzene column; and (k) removing a high water content stream containing organic amine from the benzene column receiver vessel, and combining the stream with the non-aromatic concentrate from the stripper column as aforesaid, thereby effecting introduction of organic amine in effective corrosion inhibiting concentrations to all process equipment in need of corrosion inhibition.

BRIEF DESCRIPTION OF THE DRAWING

The drawing shows a simplified diagrammatic flow scheme of the process of the invention.

DESCRIPTION OF THE INVENTION

As hereinbefore set forth, the technique encompassed by the concept of my invention is intended for integration into a solvent extraction process for the selective separation and recovery of aromatic hydrocarbons from a mixture thereof with paraffins and/or naphthenes. Initially, the mixture of hydrocarbons is contacted with a water-soluble, oxygen-containing solvent characteristically selective for the extraction of aromatic hydrocarbons. There is recovered, from the solvent extraction zone, an extract stream containing aromatic hydrocarbons and a major proportion of the water-soluble solvent, and a raffinate stream containing non-aromatic hydrocarbons and a relatively minor proportion of the water-solvent. The raffinate stream is generally contacted, in countercurrent flow, with water to recover the solvent and to provide a hydrocarbon concentrate which is substantially free from solvent.

The extract phase, removed from a lower portion of the solvent extraction column, is introduced into the upper portion of a stripping column, the principal function of which is to remove non-aromatic hydrocarbons in an overhead stream. Two types of columns currently in use are suitable for utilization herein: the first type is characterized by the introduction of a vaporous stripping medium directly into the lower portion of the stripping column for the purpose of countercurrently contacting the extract phase; in the second type, hereinafter illustrated, the stripping column is of the reboiler type wherein the required heat-input is supplied either by the external reboiling of bottoms material which is reintroduced directly, or through the utilization of a stab-in reboiler heater. The overhead stream withdrawn from the stripping column will be a hydrocarbon concentrate containing some solvent and water. This stream is condensed and introduced into a so-called overhead stripper receiver for separation into a hydrocarbon phase and a solvent/water phase. The hydrocarbon phase, substantially free from solvent and water is introduced into the lower portion of the extraction zone as reflux thereto, and to recover aromatics therein. The solvent/water phase is conveniently combined with the substantially hydrocabon-free solvent/water phase from the raffinate water-wash column, the mixture being introduced into the upper portion of a water stripping column.

The solvent-rich, aromatic concentrate, substantially free from non-aromatic hydrocarbons, withdrawn from the lower portion of the stripping column, is generally introduced into the central portion of a solvent recovery column. An aromatic concentrate, containing water and being substantially free from solvent, is withdrawn as an overhead stream from the solvent recovery column and introduced into an overhead receiver. The overhead receiver serves to effect a phase separation between the aromatic hydrocarbons, which are recovered, and the water phase which is introduced into the upper portion of the water-wash column countercurrently contacting the raffinate phase therein. A solvent-rich stream, substantially free from hydrocarbons, is withdrawn from the bottom of the solvent recovery column. The greater proportion thereof is introduced into the top of the solvent extraction zone to countercurrently contact the mixed hydrocarbon feed stream. A relatively minor portion of the solvent recovery column bottoms material is often diverted and introduced into a solvent regenerator, the regenerated solvent generally being combined with the solvent feed to the extraction zone. A solvent-rich stream, containing hydrocarbons, may be withdrawn from an intermediate portion of the solvent recovery column and introduced into the upper portion of the stripping column, preferably in admixture with the feed thereto. This technique affords advantages respecting operational costs attributed to utilities. A stripping medium may be introduced into the lower portion of the solvent recovery column. Further, a water stripping column may be employed into which the water phase from the stripper overhead receiver and from the water-wash column are introduced. The vaporous stripping medium could be withdrawn from the lower portion of the water stripping column. The condensed overhead stream from the water stripping column would be introduced into the stripper overhead receiver in admixture with the overhead stream from the stripping column. Preferably, the water stripping column would be maintained at conditions of temperature and pressure which produces the vaporous stripping medium for introduction directly into the lower portion of the solvent recovery column, as well as a solvent-containing bottoms liquid preferably introduced into the recovery column through a locus between that from which the solvent-rich sidecut is withdrawn and the stripping medium is introduced.

Hydrocarbon-containing, solvent-rich sidecut may be withdrawn from the recovery column. The introduction of the sidecut into the upper portion of the stripping column affords better separation therein between aromatic and non-aromatic hydrocarbons. Furthermore, the quantity of heat-input to the reboiler section of the main stripping column, required to strip non-aromatics from the stripper feed, would be significantly reduced.

Generally accepted solvents, having solubility selectivity for aromatic hydrocarbons, are water-soluble, oxygen-containing organic compounds, commonly referred to as the sulfolane-type. By this, a solvent is intended having a five-membered ring, one atom of which is sulfur, the other four being carbon and having two oxygen atoms bonded to the sulfur atom, all in accordance with the following structural formula:

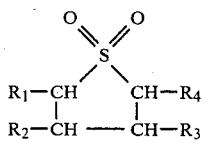

wherein $R_1$, $R_2$, $R_3$, and $R_4$ are independently selected from the group comprising a hydrogen atom, an alkyl group having from one to ten carbon atoms, an alkoxy radical having from 1 to 8 carbon atoms and an arylalkyl radical having from 1 to 12 carbon atoms.

The solvent generally contains a small amount of water dissolved therein to increase the selectivity of the solvent phase for aromatic hydrocarbons over non-aromatic hydrocarbons without substantially reducing the solubility of the solvent phase for the aromatic hydrocarbons. The presence of water in the solvent composition provides a relatively volatile material which is distilled from the fat solvent in the stripping column to vaporize the last traces of non-aromatic hydrocarbons by way of steam distillation. The solvent composition, contains from about 0.3 to about 25.0% by weight of water, depending upon the particular solvent employed and the process conditions under which the various major vessels are operated. By including water in the solvent composition, the solubility of aromatic hydrocarbons in the solvent, although somewhat reduced in comparison with a non-aqueous solvent, greatly decreases the solubility of non-aromatic raffinate components in the solvent and also reduces the solubility of solvent in the raffinate stream. Although the quantity of solvent in the raffinate at any given instance is relatively small, the cumulative effect of small amounts of solvent in a stream removed from the process flow and thus otherwise lost, greatly reduces the efficiency and economy of the solvent extraction process. The recovery of solvent from the raffinate stream can be accomplished efficiently by countercurrently washing the same with water in a separate washing zone from which an aqueous wash effluent is recovered containing the solvent.

The solvent extraction zone is maintained at conditions of temperature and pressure selected to maintain the solvent and hydrocarbons in liquid phase. Suitable temperatures are within the range of from about 80° F. (26.7° C.) to about 400° F. (204° C.), and preferably at an intermediate level in the range of about 150° F. (65° C.) to about 300° F. (149° C.). The extraction zone will generally function at a pressure from about atmospheric to about 400 psig. (28.22 atm.), and preferably from about 50 psig (4.41 atm.) to about 150 psig (11.21 atm.).

The stripping column is generally maintained at moderate pressures and sufficiently high temperatures to produce an overhead stream containing all the non-aromatic hydrocarbons. Typical pressures are in the range of about atmospheric to about 50 psig (4.41 atm.) although the pressure at the top of the stripper is generally 20.0 psia (1.36 atm.). Suitable operating temperatures are within the range of about 225° F. (107° C.) to 400° F. (204° C.). Solvent recovery is effected at temperatures ranging from about 130° F. (54° C.) to about 375° F. (191° C.). The recovery column will function at a pressure less than 1.0 atmosphere, and generally at a level of about 80 mm. Hg., absolute to about 700 mm. Hg., absolute.

The water-wash column, utilized to remove solvent from the non-aromatic raffinate, will function at a relatively low pressure of about 30 psig (3.04 atm.) to about 75 psig (6.10 atm.). Moderate temperatures are also employed, and will range from about 70° F. (21.1° C.) to about 130° F. (54° C.). The water-stripping column is maintained at temperatures in the range of about 200° F. (93° C.) to about 300° F. (149° C.), and pressures from about atmospheric to about 20 psig (2.36 atm.).

As mentioned in the above discussion of the prior art, it is known to add organic amine inhibitor to the overhead receiver of the stripping column, thus providing corrosion protection primarily to the extractor and other process equipment immediately downstream of the stripper receiver vessel. By the time, however, the process stream, i.e. extract concentrate, reaches the benzene column very little, if any, of the inhibitor will be present and there is a good chance, particularly if the unit involved is an older less efficient unit, that some sulfolane or sulfolane decomposition products will be in the process stream. It is likely, therefore, and, in fact, it has been observed that corrosion occurs in the equipment in contact with the process stream such as the benzene column, benzene column overhead condenser and benzene column overhead receiver vessel.

I have discovered that the above corrosion problem is solved by adding the organic amine to the benzene column overhead receiver vessel, preferably via the line upstream of the benzene column overhead condenser, and by recirculating water collected in that vessel to the line carrying the overhead stream from the stripping column to the stripper overhead receiver vessel, preferably upstream of the stripper overhead condenser. Make-up water will also be added to the benzene column overhead receiver vessel. It is important to note that the organic amine, particularly monoethanolamine which is the preferred organic amine for use in this process, is soluble to varying degrees both in the hydrocarbon and water phases, and will therefore be dissolved in both the water and hydrocarbon streams withdrawn from the benzene column overhead receiver and stripper column overhead receiver. The amount of organic amine needed varies greatly from unit to unit and, although largely dependent on the amount of air that leaks into the unit will usually be in terms of less than 2 liters per day in a unit that processes thousands of barrels per day.

The advantages of my invention may be summarized as follows:

1. The benzene column and associated equipment, such as the overhead condenser, is protected from sulfolane decomposition products that may be present in the extract stream.

2. Total organic amine use is reduced since most of the organic amine removed from the benzene column system will be used again in the extraction system.

3. Net water consumption will be reduced since almost all of the water in the extract will be returned to the extraction section.

4. There will be no waste water stream from the process that need be disposed of since all water is in effect recycled to extinction, i.e. water leaves the process in solution with non-aromatic hydrocarbon product stream in which it has a small but finite solubility.

With specific reference now to the drawing, which presents an illustration as a simplified diagrammatic flow scheme, it will be noted that only the major vessels are shown. These are: solvent extraction zone 1; raffinate water-wash column 2; stripping column 3 and the stripper overhead receiver 4; the solvent recovery column 5 and the recovery column overhead receiver 6; water-stripping column 7; and, benzene column 8.

The aromatic-rich charge stock is introduced into extraction zone 1, via line 9, through an intermediate locus. In an operating commercial system, a plurality of feed loci is provided to afford flexibility in adjusting for changes in feed rate and aromatic/non-aromatic feed ratios. Solvent, in this case an aqueous solution of sulfolane, is introduced through an upper locus via line 10. A bottoms reflux stream, from line 19, the source of which is hereinafter set forth, is introduced into extractor 1.

A non-aromatic raffinate stream, is withdrawn as an overhead stream from extractor 1 and introduced, via line 11, into waterwash column 2, after cooling. A solvent rich aromatic concentrate, is withdrawn from extraction zone 1 by way of line 14. In many solvent extraction processes, a portion of the raffinate, withdrawn via line 11, is recycled, without intermediate heating or cooling, to combine with the charge stream in line 9. Since this modification is not necessary to the present invention, it has not been illustrated in the drawing. The raffinate introduced by way of line 11 is countercurrently contacted with a water stream introduced via line 24. Net non-aromatic raffinate, substantially free from solvent, and containing a minor amount of aromatic hydrocarbons, is recovered via line 12 and transported thereby to suitable storage facilities. A water containing stream of sulfolane is recovered through line 13.

The solvent-rich material in line 14, is introduced thereto into stripping column 3. In this illustration, stripper 3 is of the reboiler type as contrasted to one wherein a vaporous stripping medium is introduced directly into the reboiler section of the column. Also introduced into stripping column 3, preferably in admixture with the feed stream in line 14, is a solvent-rich stream in line 25 which has been withdrawn as a sidecut from solvent recovery column 5. The stream in line 25 comprises sulfolane and hydrocarbons. Stripper overhead vapor, of which about 9.5% by volume is sulfolane and water, is withdrawn through line 15, condensed by means of condenser 41, and introduced by way of line 16 into stripper overhead receiver 4. Stripper bottoms, substantially free from non-aromatic hydrocarbons, are removed from stripper 3 through line 20 and introduced thereby into solvent recovery column 5.

Solvent recovery column 5 is maintained at conditions of temperature and pressure sufficient to provide a substantially solvent-free aromatic overhead product in line 21. The aromatic concentrate is recovered in line 21. The vaporous overhead material is condensed by means of condenser 42 and introduced into recovery column receiver 6. The aromatic concentrate is recovered by way of line 38 and transported via line 40 to clay treater 47 wherein olefins contained in the concentrate are polymerized. From the clay treater the concentrate is transported via line 46 to the benzene column for the separation of benzene from the aromatic components. Part of the aromatic concentrate is refluxed back to the recovery column via line 39. Water is withdrawn through dip-leg 23 and introduced via line 24 into raffinate water-wash column 2. A vacuum may be drawn on receiver 6 via line 22 to remove non-condensible gases from the system.

Referring now to stripper overhead receiver 4, the feed thereto constitutes water, withdrawn as an overhead vapor in line 16 from water stripper 7, and stripping column 3 overhead vapors in line 15. Receiver 4 effects a phase separation whereby the hydrocarbon portion is removed via line 19 to be introduced into extractor 1 as a bottoms reflux stream. A concentrated water stream, containing about 1.2% by volume of sulfolane, is withdrawn from dip-leg 17 through line 18. The wash water from column 2 is admixed via line 13, and the mixture continues through line 18 into an upper portion of water-stripping column 7.

Water stripper 7 functions at a top temperature of about 230° F. (110° C.), a top pressure of about 6.0 psig (1.41 atm.), a bottom temperature of about 250° F. and a bottom pressure of about 7.0 psig (1.48 atm.). Overhead vapors from water stripper 7 containing some non-aromatic hydrocarbons, are withdrawn through line 16, condensed and introduced into stripper receiver 4, in admixture with stripping column 3 overhead vapors. Heat-input to water stripper 7 is supplied by way of indirect heat-exchange with a lean solvent stream introduced via conduit 28 into reboiler section 29, and exiting therefrom through conduit 30. Stripping vapors are withdrawn through line 26 and introduced thereby directly into the lower portion of recovery column 5. The principal purpose of this technique is to maintain the lean solvent concentrate in line 10, virtually completely free from aromatic hydrocarbons which otherwise would be introduced into the extraction zone with the solvent. As little as 0.5% aromatics in this stream will have an adverse effect upon the efficiency of separation above the feed locus in extractor 1. Also introduced into an intermediate locus of recovery column 5 is a liquid phase from reboiler section 29, via line 27, containing water and solvent.

Solvent containing aromatics is withdrawn as a sidecut through line 25, and introduced thereby into admixture with the extract phase in line 14; the mixture continues through line 14 into stripping column 3.

Heavy aromatics products are withdrawn from the bottom of benzene column 8 by line 33. Benzene product is withdrawn near the top of the column by line 36. Benzene vapor is passed from the top of the column via line 32, through condenser 43 where they are condensed to a liquid, and from there into benzene column receiver 37. Benzene is refluxed to column 8 via line 34.

In accordance with my invention, organic amine is added to benzene column receiver 37 by injection line 44. It is preferred that the make-up water added to the process be introduced into receiver 37. My invention also requires that the water collected in dip-leg 45 of receiver 37, which will contain a substantial portion of the organic amine added, by recycled via line 35 to line 16, preferably upstream of condenser 41, and from there, via line 16, to stripper receiver 4. Organic amine will be contained in both the hydrocarbon and water phases leaving receiver 4. The net effect of my invention, as clearly illustrated, is to provide the most efficient possible utilization of the organic amine and an organic amine presence in all essential equipment subject to corrosion. Furthermore, as is clearly illustrated, a waste water stream is eliminated. I claim as my invention:

1. A process for the recovery of aromatic hydrocarbons from a mixture thereof with non-aromatic hydrocarbons while reducing corrosion of process equipment, which process comprises the steps of:

a. introducing said mixture into an extraction zone, and therein contacting said mixture with a solvent comprising a sulfolane type organic compound characteristically selective for absorbing aromatic hydrocarbons;

b. removing a non-aromatic raffinate stream from said zone, through an upper locus thereof;

c. removing an aromatic, solvent-rich extract stream from said zone, through a lower locus thereof, and introducing said extract stream into a stripper column;

d. removing a non-aromatic concentrate from said stripper column, through an upper locus thereof, and removing a solvent-rich aromatic concentrate from said stripper column, through a lower locus thereof;

e. combining said non-aromatic concentrate with a hereafter described high water content stream containing organic amine and introducing the combination into a stripper receiver vessel, removing non-aromatic concentrate containing organic amine from said stripper receiver vessel and passing said non-aromatic concentrate containing organic amine as reflux into said extraction zone;

f. introducing said aromatic concentrate into a recovery column, recovering a substantially solvent-free aromatic concentrate through an upper locus thereof, and removing a substantially hydrocarbon-free solvent-rich stream from a lower locus thereof;

g. introducing said solvent-free aromatic concentrate into a benzene column, recovering a substantially pure benzene concentrate through an upper locus thereof, and removing a substantially benzene-free aromatic product stream from a lower locus thereof;

h. introducing said benzene concentrate into a benzene column receiver vessel;

i. introducing an organic amine into said benzene column receiver vessel;

j. removing benzene reflux containing organic amine from said benzene column receiver vessel and introducing said reflux to said benzene column; and k. removing a high water content stream containing organic amine from said benzene column receiver vessel, and combining said stream with said non-aromatic concentrate from said stripper column as aforesaid thereby effecting introduction of organic amine in effective corrosion inhibiting concentrations throughout the process equipment.

2. The process of claim 1 wherein said organic amine comprises monoethanolamine.

3. The process of claim 1 wherein said sulfolane type chemical is of the general formula:

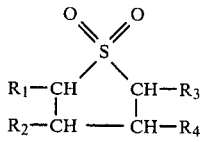

wherein $R_1$, $R_2$, $R_3$ and $R_4$ are independently selected from the group consisting of a hydrogen atom, an alkyl group having from 1 to 10 carbon atoms, an arylalkyl radical having from 1 to 12 carbon atoms, or an alkoxy radical having from 1 to 8 carbon atoms.

4. The process of claim 1 wherein the respective streams introduced into said stripper receiver vessel and said benzene column receiver vessel are first passed through condensers wherein at least a portion of the condensible components in said streams are changed from gas to liquid phase.

5. The process of claim 4 wherein said high water content stream containing organic amine in step j. is combined with said non-aromatic concentrate upstream of the condenser associated with said stripper receiver vessel.

6. The process of claim 1 wherein make-up water to said process is introduced into said benzene column receiver vessel.

* * * * *